US006260300B1

(12) United States Patent
Klebes et al.

(10) Patent No.: US 6,260,300 B1
(45) Date of Patent: Jul. 17, 2001

(54) BIOMETRICALLY ACTIVATED LOCK AND ENABLEMENT SYSTEM

(75) Inventors: John F. Klebes, Feeding Hills; Robert L. Constant, Westfield; Gerard G. Parent, Chicopee, all of MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/296,014

(22) Filed: Apr. 21, 1999

(51) Int. Cl.[7] ..... F41A 17/00
(52) U.S. Cl. ..... 42/70.11; 70/63; 206/317
(58) Field of Search ..... 42/70.06, 70.07, 42/70.11; 211/4, 64

(56) References Cited

U.S. PATENT DOCUMENTS

| | | | | |
|---|---|---|---|---|
| 3,942,691 | | 3/1976 | Sisak | 224/1 R |
| 4,467,545 | * | 8/1984 | Shaw, Jr. | 42/70 R |
| 4,768,021 | * | 8/1988 | Ferraro | 340/568 |
| 5,012,606 | | 5/1991 | McNulty, Jr. | 42/70.11 |
| 5,392,552 | * | 2/1995 | McCarthy | 42/70.07 |
| 5,448,847 | * | 9/1995 | Teetzel | 42/70.11 |
| 5,579,909 | * | 12/1996 | Deal | 206/317 |
| 5,603,179 | * | 2/1997 | Adams | 42/70.08 |
| 5,675,925 | * | 10/1997 | Wurger | 42/70.11 |
| 5,701,770 | * | 12/1997 | Cook | 70/63 |
| 5,704,151 | * | 1/1998 | West | 42/70.07 |
| 5,713,149 | * | 2/1998 | Cady | 42/70.06 |

* cited by examiner

*Primary Examiner*—Charles T. Jordan
*Assistant Examiner*—Francis T. Palo
(74) *Attorney, Agent, or Firm*—McCormick, Paulding & Huber LLP

(57) ABSTRACT

A system for locking, storing, enabling and disabling a device such as a conventional firearm, or an electronic firearm through the use of a control system that is responsive to biometric data input utilizes biometric data input devices to enable both unlocking of a locking box or a trigger lock apparatus, as well as operation and firing of an electronically-controlled firearm that has such features as an electronic locking system onboard or an electronic firing system, in a single authorization entry of biometric data.

30 Claims, 10 Drawing Sheets

BIOMETRICALLY ACTIVATED LOCK AND ENABLEMENT SYSTEM

RELATED APPLICATION

This application is related to co-pending U.S. patent applications Ser. Nos. 09/206,013 and 09/205,391, which are assigned to the Applicant of the present invention. Each one is incorporated herein by reference.

TECHNICAL FIELD OF THE INVENTION

The present invention relates to locking storage receptacles and locking or disabling mechanisms and controls for firearms and other devices requiring secured access and, more particularly, to methods and apparatus for preventing unauthorized access to or use of a firearm or other article by securing the firearm or article in a safe box or with a mechanical lock, or by disabling operational access, and thereby requiring use of a biometric data recognition system to unlock the handgun or article or to gain operational access.

BACKGROUND OF THE INVENTION

The use of handgun locking systems and safe boxes for storing and locking handguns for the purpose of preventing unauthorized access and use is generally known. Such systems are useful for limiting access to handguns in private and commercial or public settings. In private residential settings, for example, it is desirable to prevent unauthorized access to and use of handguns by children, intruders, or other unauthorized individuals. In commercial or public settings, it is desirable to prevent unauthorized access to and use of handguns in situations where handguns are subject to theft or are inadvertently misplaced.

Some known systems use purely mechanical locks that comprise cumbersome mechanical components and the use of a key, a combination dial, or similar means. Such mechanical locks require time to manipulate a key or enter a combination. This is undesirable in situations where it may be necessary to quickly access and utilize a handgun. The mechanical components are subject to wear and failure. Keys and combinations can be obtained by unauthorized individuals. These drawbacks and others make the use of mechanical locks undesirable.

Other systems utilize electronic code-entry systems for electromechanical locking means. For example, some systems require that a code be keyed in on a keypad. These systems are subject to the same drawbacks as mechanical systems where codes can be accessed and used by unauthorized personnel or entry and access is undesirably delayed due to the time to key in the code. Access may be altogether prevented where a user cannot remember the access code.

Certain systems utilize fingerprint or thumbprint scanning technology for authorizing the opening of an electronic lock for a security box. Recently developed technology, including that disclosed in co-pending U.S. patent applications Ser. Nos. 09/206,013 and 09/205,391, utilizes fingerprint or thumbprint scanning technology to activate or enable an operational mode necessary for firing an electronic handgun or for operating a device.

SUMMARY OF THE INVENTION

The present invention is directed to various embodiments for locking, storing, enabling and disabling a device such as a conventional firearm, or an electronic firearm through the use of a control system that is responsive to biometric data input. The present invention utilizes fingerprint scanning devices to enable both unlocking of a locking box or a trigger lock apparatus, as well as operation and firing of an electronically-controlled firearm that has such features as an electronic locking system onboard or an electronic firing system, in a single authorization entry of fingerprint data.

The present invention system achieves the objectives of providing a locking and/or control system that is highly secure, yet can be unlocked and activated quickly, without being subject to the aforementioned drawbacks of known systems. By utilizing a biometric authorization system, such as fingerprint scanning, the risks of losing or misplacing a key, forgetting or inadvertently distributing a code and the like are eliminated. The present invention system has utility not only in locking or securing systems, but also in future electronically operated devices such as electronically operated firearms by providing signal input system that is transferable from a locking system to an operating system.

These and other objectives are achieved by the invention as described below.

DESCRIPTION OF THE PREFERRED EMBODIMENTS

The present invention is directed to various embodiments for locking, storing, enabling and disabling a conventional firearm, such as a handgun, or an electronic firearm, through the use of a control system that is responsive to biometric data input. The various embodiments of the present invention share common features including a novel integration of biometric authorization systems with operational locking or firing enablement systems. This feature is described at the outset, in terms of fingerprint or thumbprint scanning access systems. It is understood that other biometric systems, not limited to fingerprint or thumbprint systems, may be implemented with the present invention. For the purpose of this description, the term "fingerprint" shall collectively refer to both fingerprint and thumbprint unless specifically stated otherwise.

The fingerprint scanning and signaling system according to the present invention utilizes a commercially available fingerprint scanner such as the THOMSON-CSF SEMICONDUCTEURS SPECIFIQUES FINGERCHIP(TM). By integrating the fingerprint scanner with appropriate hardware and software, a self-contained system for scanning and processing fingerprint data to control access to, or operation of, a handgun according to one of the preferred embodiments is achieved. An example of a suitable hardware/software system for this purpose is the OXFORD MICRODEVICES A236 VIDEO DIGITAL SIGNAL PROCESSOR CHIP. Other fingerprint-based or biometric authorization systems are commercially available and may be provided as suitable alternatives.

As will be described below with reference to specific embodiments, the biometric or fingerprint scanning and processing system is integrated with one or more physical locking systems for a handgun trigger or storage box, or an electronic control system for enabling operation of a handgun, or both. The present invention is not necessarily limited to such embodiments and may be applied to other types of locking or access systems such as, for example, a cable lock.

Biometric Scanning and Authorization System and Procedure

The biometric scanning and authorization system, in accordance with the above-mentioned hardware and software products, is configured and programmed to carry out the procedure described herein. The system and procedure may be applied to each of the following physical embodiments described below. In addition to fingerprint image signals, it may be used with different types of biometric signals, such as digital voice recognition signals.

Figure 1:
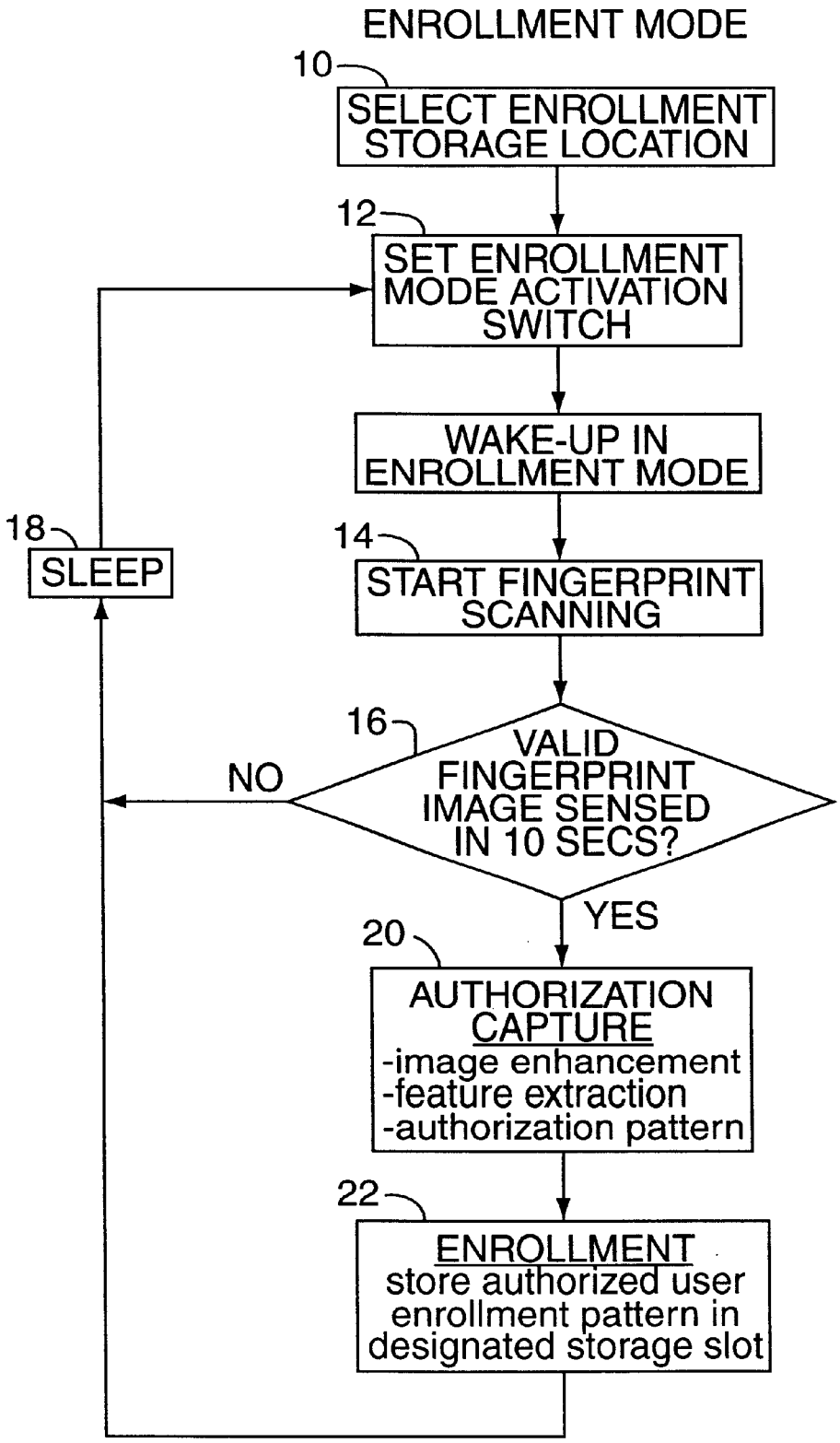
FIG. 1 is a flow diagram of an enrollment mode sequence according to the present invention.
Figure 2:
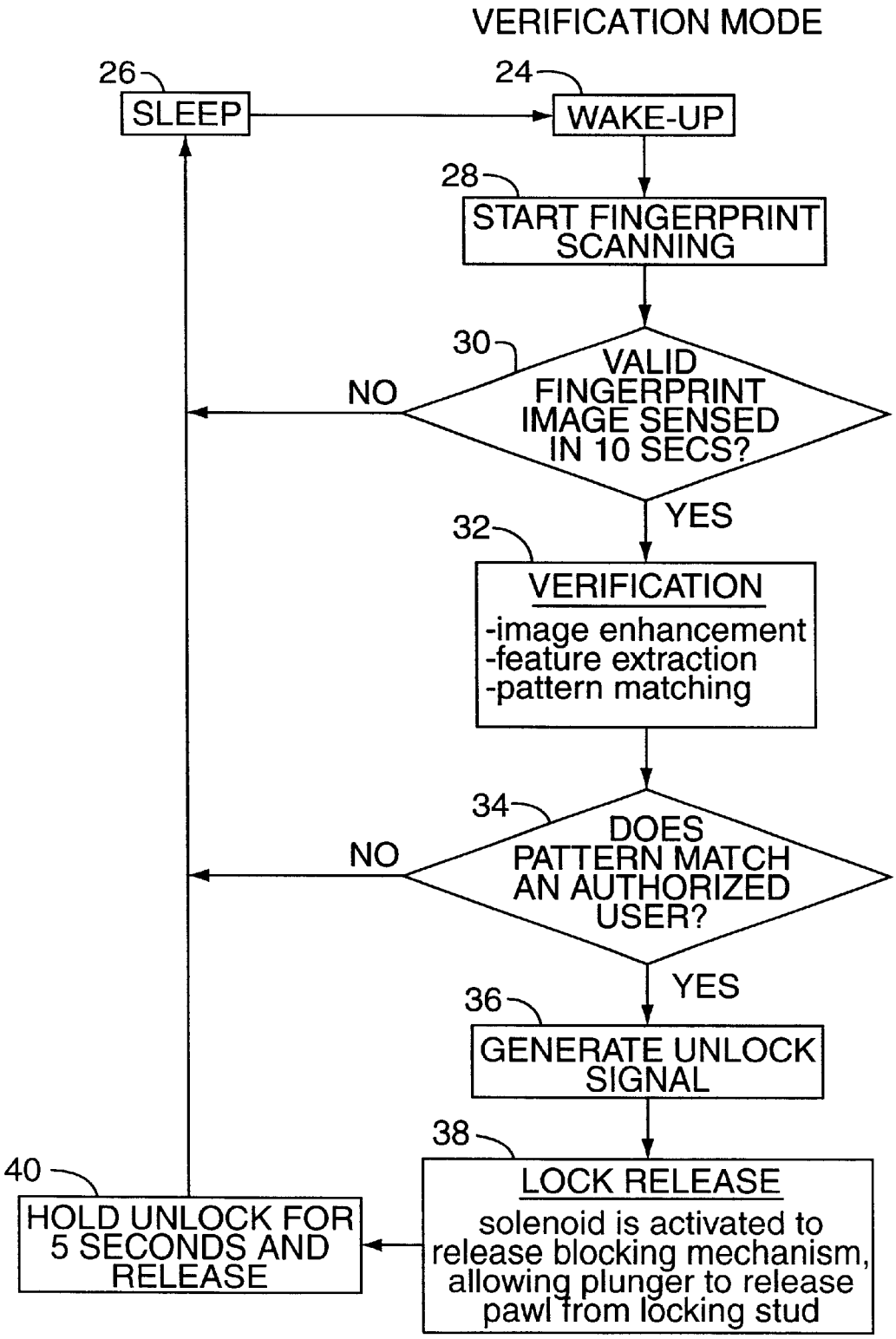
FIG. 2 is a flow diagram of a verification mode sequence according to the present invention.

Referring to FIGS. 1–2, the operation sequence of entering and processing a fingerprint image and associated data in accordance with the various embodiments of the present invention is described. Referring to FIG. 1, an enrollment mode is commenced by first selecting an enrollment storage location (10) by manipulating a switch, as described below, indicative of the storage location for a single user fingerprint. The enrollment mode activation switch is then switched (12) to activate the enrollment mode process by the controller (described below). Once the enrollment mode is activated, a fingerprint image is captured (14) by the scanner when a user swipes his finger across a scanning window. Alternative types of fingerprint reading systems may be utilized, such as a static sensor where the user merely positions his finger on a sensor window. The scanning step can be set to depend on a timer so that time-out (16) occurs if a valid fingerprint image is not sensed within ten seconds.

If a valid fingerprint image is not sensed within the time-out period, the system reverts to a sleep mode (18) and the enrollment mode activation switch must again be activated to wake up the system in enrollment mode and begin fingerprint scanning again.

If a valid fingerprint image is sensed within the time-out period, the image is captured (20). Further processing including image enhancement and feature extraction is performed until an authorization pattern is made ready. The authorization pattern is stored (22) in the designated storage location for future comparison.

After one or more authorized users have enrolled their fingerprints into the system, a user may activate or unlock the system, using the verification mode, illustrated in FIG. 2, by scanning a fingerprint for comparison. The verification cycle starts by causing a wake-up state (24) from a sleep mode (26). The wake-up state (24) can be initiated by powering on or by otherwise signaling the system such as, for example, physically disturbing the system. After wake-up mode (24) is initiated, the user can swipe his finger across the scanner window and the system will begin scanning the fingerprint (28).

If a valid fingerprint image is not sensed within a time-out period, such as ten seconds, the system reverts (30) to the sleep mode (26) until wake up initiation (24) is again initiated.

If a valid fingerprint image is sensed within the time-out period, the image is captured (32). Further processing including image enhancement and feature extraction is performed until an entry pattern is made ready. The entry pattern is compared (34) to the authorization patterns that have been stored by authorized users by way of the afore-described enrollment mode.

If the entry pattern does not match an authorization pattern the system reverts back to sleep mode (26) and must re-start in wake-up mode (24).

If the entry pattern does match an authorization pattern, the system generates an unlock signal and/or authorization signal (36). The unlock signal is received by a controller that enables unlocking or activation of a handgun or a handgun storage device, as described below with respect to one or more of the preferred embodiments. For example, the unlock signal may cause a solenoid to release a blocking mechanism (38) in a mechanical lock. The signal may also be an authorization signal to commence operation of an electronic firearm.

The unlock or authorization signal can be provided with a time-out period (40) so that after a predetermined amount of time, for example five seconds, the unlock signal no longer enables unlocking or activation. After expiration of the time-out period for the unlock signal, the system reverts to sleep mode.

Locking Container

Figure 3:
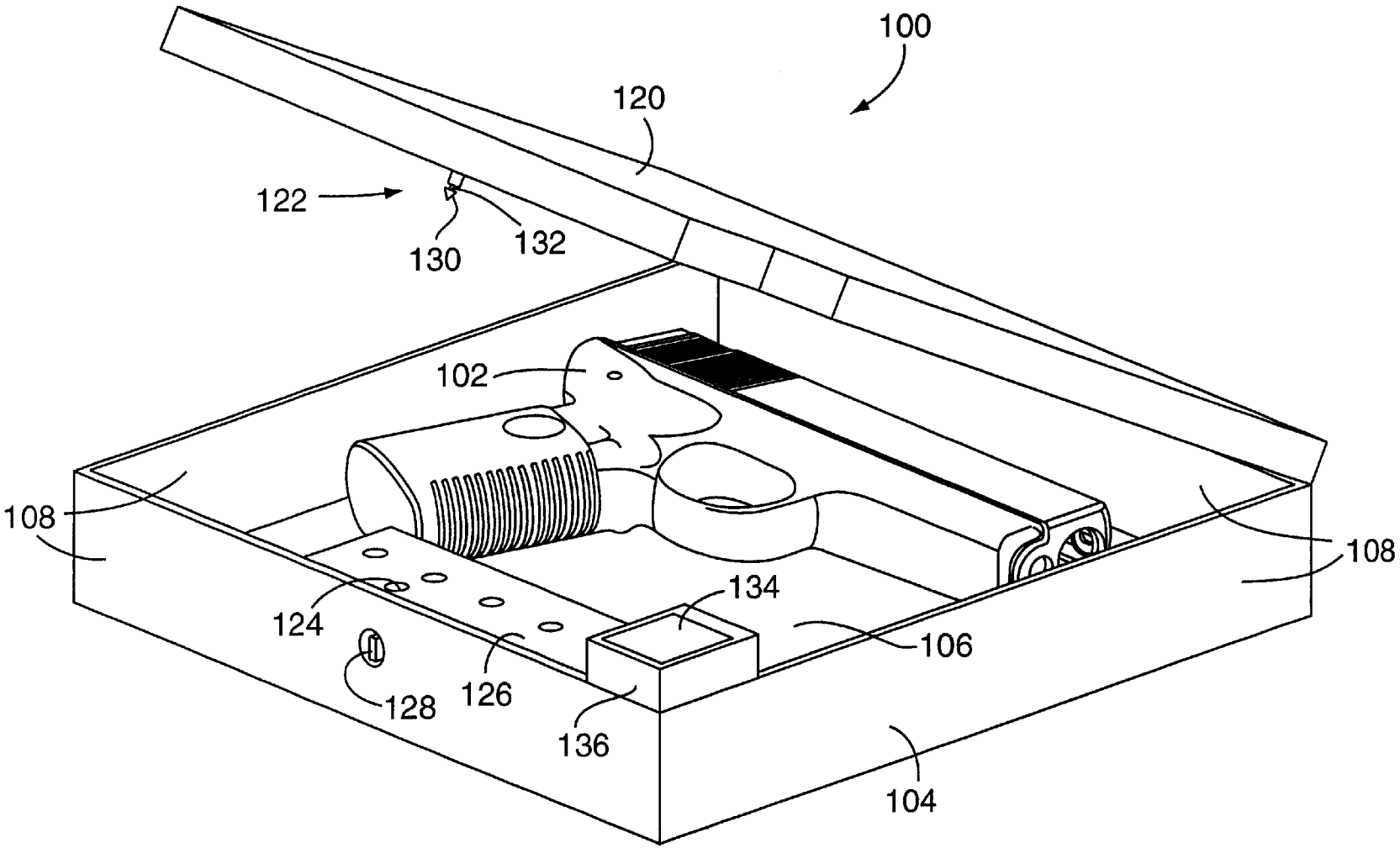
FIG. 3 is a schematic, orthogonal view of a first embodiment of the present invention, directed to a locking container for a handgun.

A first embodiment of the present invention, directed to a locking box (100) for securely storing a handgun (102) is illustrated in FIG. 3. The locking box (100) includes a bottom portion (104) having a generally flat base (106) and four generally vertical walls (108), and a top portion (120) connected to the bottom portion (104) by hinges (not shown). The top portion (120) is adapted to pivotally open and close with respect to the bottom portion (104) to form a generally rectangular box. The locking box (100) may be made of one or more of various structural materials such as metal, plastics, or wood. Preferably, the material selected is of sufficient strength and durability to securely hold the handgun (102) and not be easily destroyed or opened.

The safe box (100) is adapted to be locked in a closed position by a spring-loaded latch system comprising a top engagement member (122) having a cam surface (130) and groove (132) type lock profile protruding from the upper portion (120) of the locking box (100) so as to mate with a retention opening (124) in a lock housing (126) which is mounted in the lower portion (104) of the locking box (100). A spring-loaded lock latch (128) is adapted to be manipulated by a user to move internal mechanisms (not shown), of a conventional type, out of engagement with the groove surface (132) of the top engagement member (122) in order to release and open the upper portion (120) of the locking box (100). When the latch (128) is released, spring force causes it to move to a default lock position. The cam surface (130) of the top engagement member (122) biases the internal mechanisms out of the way, against spring force, to enable the top engagement member (122) to move into a locking position when the top portion (120) is closed.

A solenoid (not shown) having a movable bar (not shown), of a conventional type, is provided within the lock housing and is arranged so that the bar moves into and out of a position which blocks operability of the latch (128). The solenoid is controlled by the unlock signal, referred to with respect to FIG. 2, which causes the solenoid bar to move out of blocking position of the latch (128) for the predetermined time-out period discussed above. The unlock signal is generated in response to a fingerprint pattern match after entry of a valid fingerprint image into the scanner pad (134).

The scanner pad (134) is mounted on a block (136) which is, in turn, mounted to the bottom portion (104) of the locking box (100) so that it is accessible when the upper portion (120) of the locking box (100) is in the closed or opened position. The scanner pad (134) is electrically connected to a circuit board (not shown) located within the lock housing (126). The scanner pad (134) enables a user to swipe a finger or thumb across the pad so that a scan of the print can be made and compared to pre-stored signals, as described above, to activate an authorization signal, thereby moving the solenoid bar to enable release of the latch (128) and opening of the locking box (100) so that the handgun (102) may be accessed. The scanner pad (134) may be located on any other part of the locking box (100) as desired, or it may be located remotely via wiring or RF. A battery compartment (not shown) is located within the lock housing (126) and may be accessible through a compartment lid (not shown) located on the underside of the lower portion (104) of the locking box (100). If desired, a lighted display (not shown) showing status or mode of operation, and/or battery level, may be provided on any surface such as on the same surface as the scanner pad (134).

Locking Container With Electronic Gun Authorization

The preceding embodiment described with respect to FIG. 3 may be modified to include, in addition to the features and functions of the embodiment described with respect to FIG. 3, means for enabling operation or activation of an electronic gun.

Electronic handguns, such as the types disclosed in co-pending U.S. patent applications Ser. Nos. 09/206,013 and 09/205,391, are activated and/or caused to fire by electronic signals. These types of firearms may implement electronic ignition or firing of electronically ignited ammunition. Other types of electronic handguns utilize a conventional mechanical firing pin, but are equipped with internal electronic authorization systems to enable or disable firing mechanisms. In either type of firearm, electronic controls must be activated and operated to generate fire ready and firing signals. The controls are located on the handgun itself.

Figure 4:
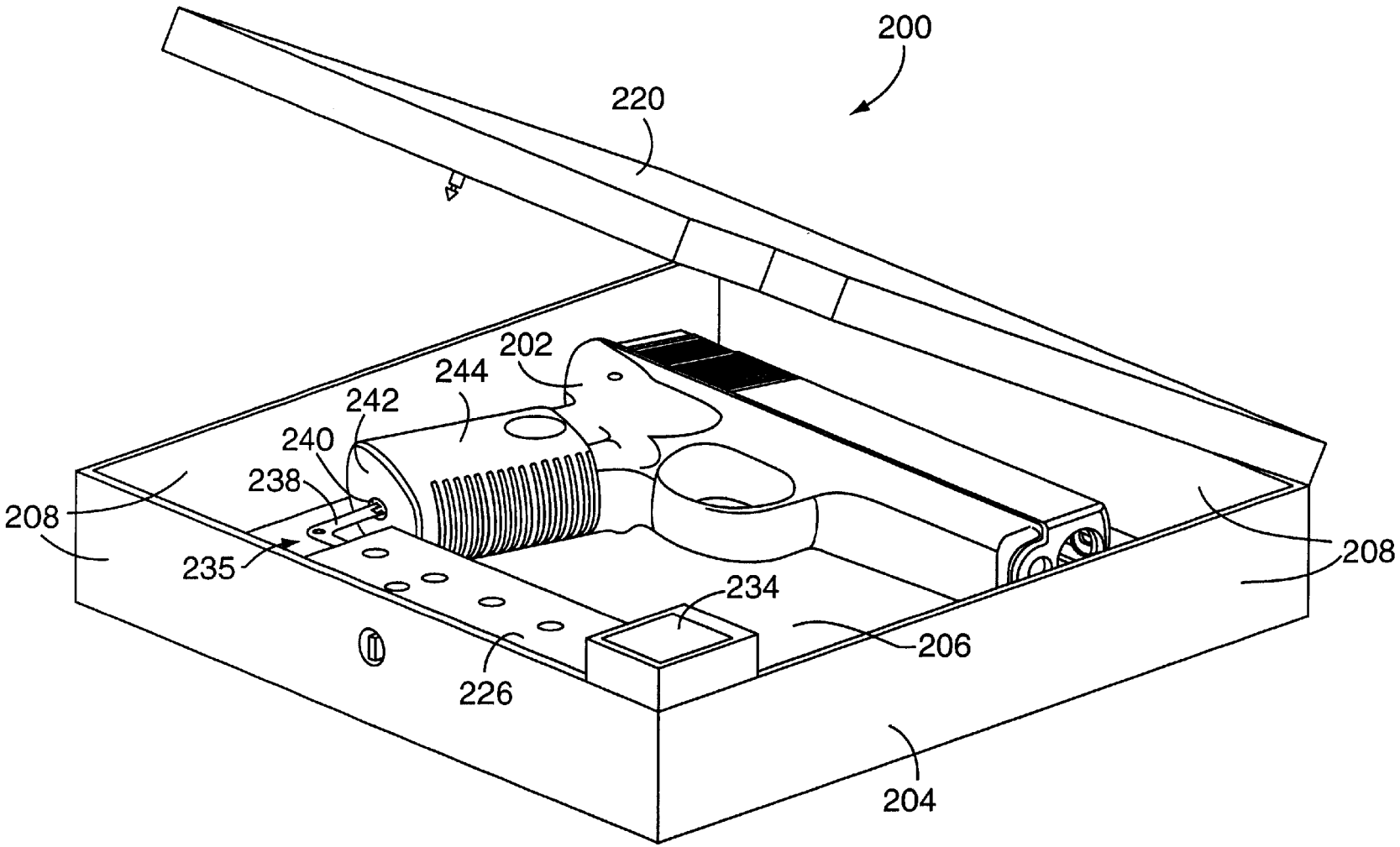
FIG. 4 is a schematic, orthogonal view of a second embodiment of the present invention, directed to a locking system for a handgun.
Figure 5:
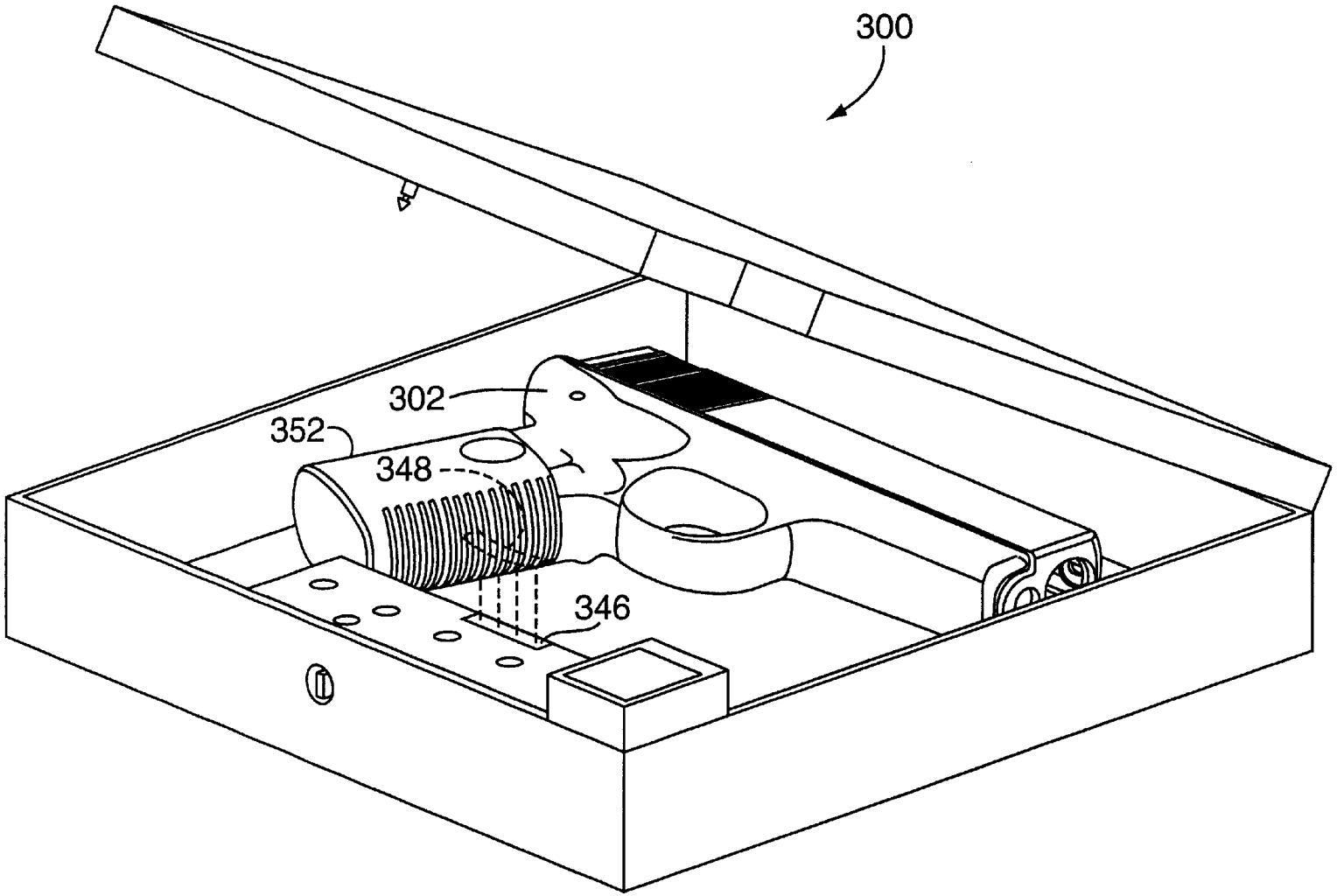
FIG. 5 is a schematic, orthogonal view of a third embodiment of the present invention, directed to a locking system for a handgun.
Figure 6:
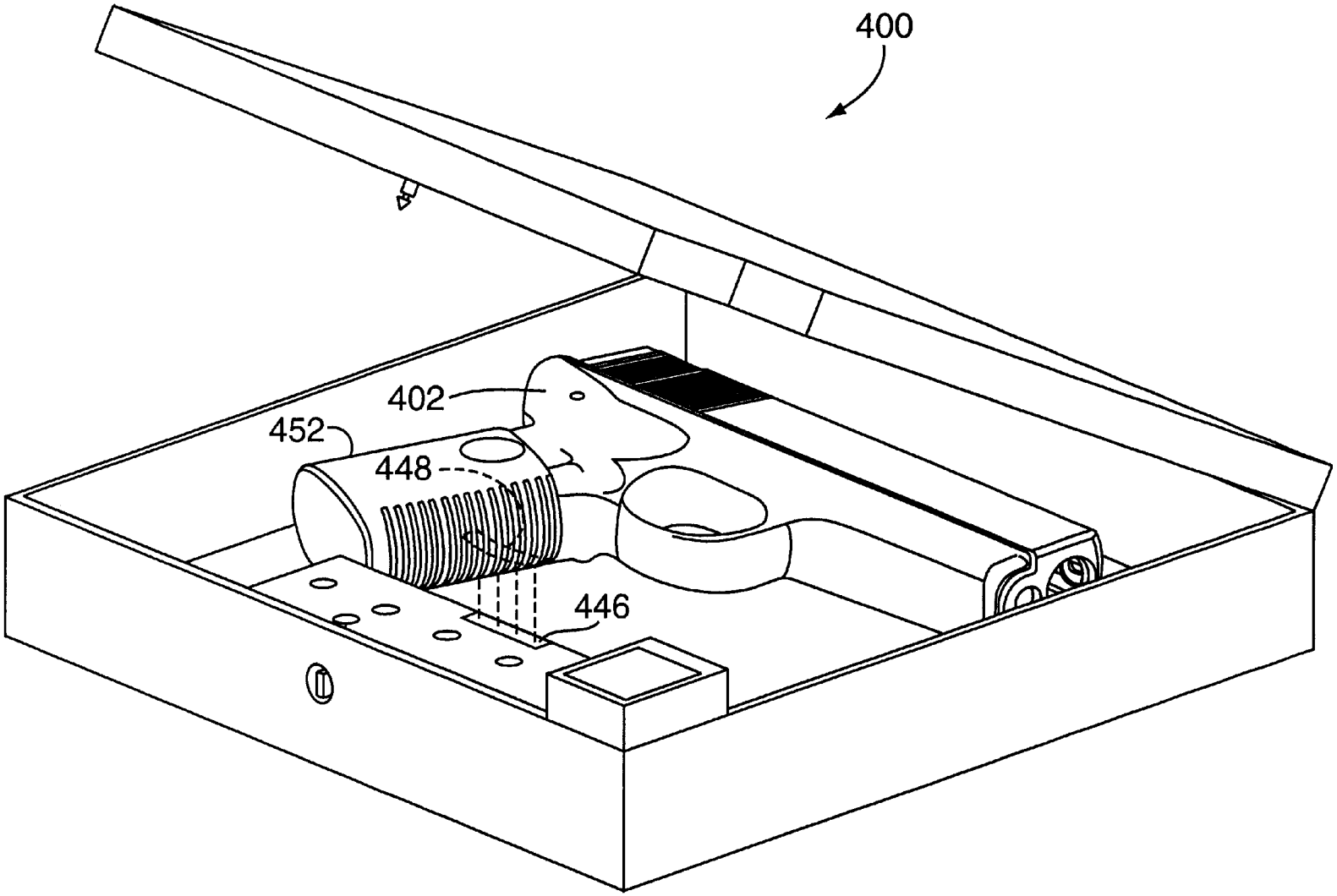
FIG. 6 is a schematic, orthogonal view of a fourth embodiment of the present invention, directed to a locking system for a handgun.
Figure 7:
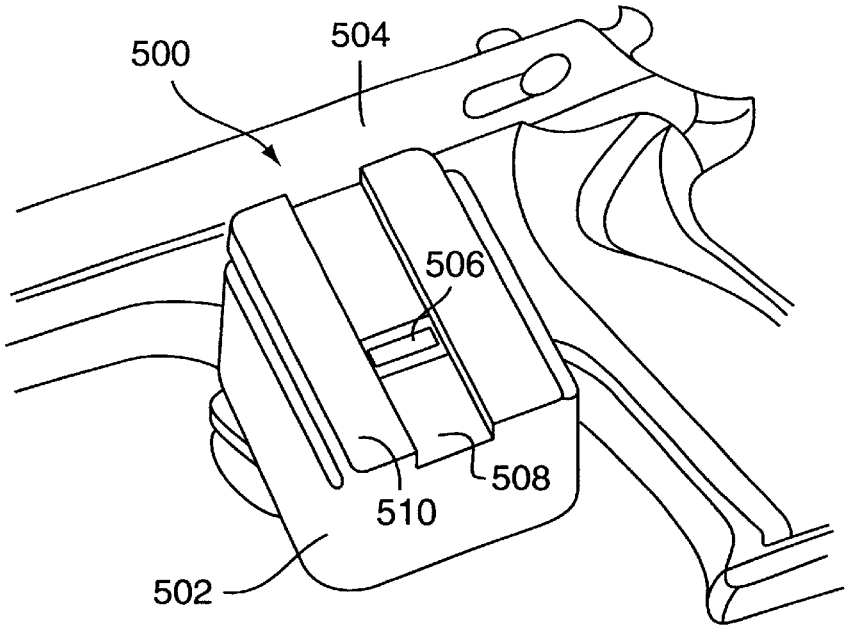
FIG. 7 is a schematic, orthogonal view of a fifth embodiment of the present invention, directed to a trigger lock system.

The embodiments of the present invention illustrated in FIGS. 4–6 are similar to the embodiment described in FIG. 3, and further include means for electronically communicating with the firearm through the fingerprint scanner and electrical control means mounted on the locking box.

With regard to FIG. 4, a locking box (200) for securely storing a handgun (202) includes a bottom portion (204), a base (206) and four generally vertical walls (208), and a top portion (220) connected to the bottom portion (204) by hinges (not shown). The top portion (220) is adapted to pivotally open and close with respect to the bottom portion (204) to form a generally rectangular box. The safe box (200) is adapted to be locked in a closed position by a spring-loaded latch system of the type described with respect to FIG. 3. The safe box (200) further comprises a solenoid (not shown) having a movable bar (not shown), of the conventional type, which is arranged so that the bar moves into and out of a position which blocks operability of a latch. The solenoid is controlled and operates in a manner similar to that described with respect to FIG. 3.

A scanner pad (234), similar in structure and operation to that described with respect to FIG. 3, is provided to enable a user to swipe a finger or thumb across the pad (234) so that a scan of the print can be made and compared to pre-stored signals, as described above, to activate an authorization signal (36), thereby enabling access to and operation of the handgun (202).

The system illustrated in FIG. 4 further includes an electronic connection (235) that electrically and operatively connects the electrical components of an electronic handgun (202) to the electronic components of the locking box (200) that are contained in the lock housing (226). A preferred form of the electronic connection (235) is a folding, pivotable plug member (238), as shown, for moving into and out of engagement position with the electronic handgun (202) when it is placed into the locking box (200). The plug member (238) is received in a jack (240) in the base (242) of the handle (244) of the handgun (202).

Alternatively, as shown in FIG. 5, an RF transmitter (346) can be positioned inside a locking box (300), similar to that described with respect to FIG. 3, and an RF receiver (348) can be located on the handle (352) of the handgun (302). When the handgun (302) is placed in the locking box (300) it can be docked by putting the RF transmitter (346) and receiver (348) into communication with each other so that control signals can transfer from the locking box (300) to the handgun (302) via RF transmission.

Referring to FIG. 6, an infra red (IR) transmitter (446) can be positioned inside a locking box (400), similar to that described with respect to FIG. 3, and an IR receiver (448) can be located on the handle (452) of the handgun (402). When the handgun (402) is placed in the locking box (400) it can be docked by putting the IR transmitter (446) and receiver (448) into communication with each other so that control signals can transfer from the locking box (400) to the handgun (402) via IR transmission.

In the embodiments of FIGS. 4–6, the user can enter his fingerprint into the scanner pad to operatively signal the handgun. With respect to these embodiments, the user's fingerprint image is captured by the scanner and processed by the system contained in the locking box, as previously described, to generate a control signal that is transmitted directly from the locking box to the electronic handgun. Depending on the type of electronic gun, the control signal can activate an unlock condition to release a locked firing mechanism, or it can initiate an operation sequence of signals for an electronically fired handgun.

If the handgun is, for example, an electronic firearm of the type disclosed in U.S. patent applications Ser. No. 09/206, 013 and 09/205,391, the signals generated in response to the fingerprint scan of a user into the scanner mounted on the locking box first cause movement of a solenoid bar out of the way to enable unlocking of the locking box. Next, the signals are transmitted from the locking box (200) to the electronic handgun (202) to activate or enable authorization and operation sequences in accordance with the sequence of the on-board system of the electronic handgun. The signal for operating and firing an electronic firearm may be generated in the locking box or on-board the firearm, having received an initial signal from the locking box.

The embodiments described with respect to FIGS. 3, 4, 5 and 6 can each be provided with manual override systems, such as key and lock mechanisms. In the event of electronic malfunction or power failure, a manual key and lock or similar means can unlock or enable operation of a locking box and/or handgun.

Another embodiment of the present invention, illustrated in FIGS. 7–13 is directed to a trigger lock system (500) comprising a lock body (502) adapted to be secured to a handgun (504) in a manner so as to disable it until the trigger lock system (500) is removed from the handgun (504). The lock body (502) comprises a generally cube-shaped or rectangular casing having a scanner (506) mounted in a channel (508) on the back wall (510) of the lock body (502) to facilitate swiping or positioning of a user's finger or thumb across the scanner to produce a signal responsive to a scanned print image.

Figure 8:
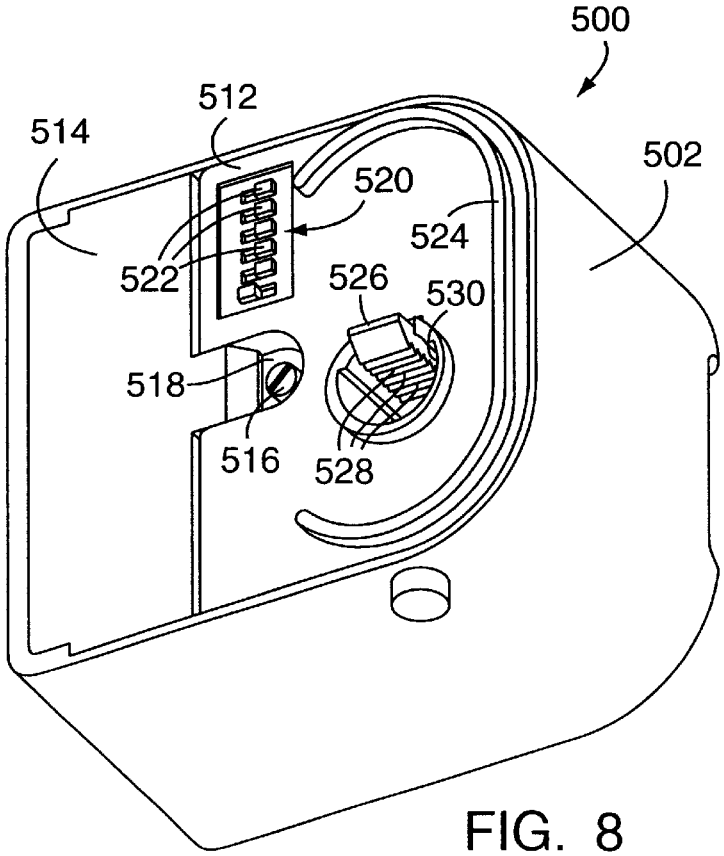
FIG. 8 is a schematic, partial view of the embodiment of FIG. 7.

As shown in FIG. 8, the front wall (512) of the lock body (502) comprises a battery compartment lid (514) secured to the front wall (512) by a screw (516) in a recess (518). The battery compartment lid (514) securely covers a battery compartment (not shown) inside the lock body (502). A bank (520) of switches (522) is provided to enable a user to selectively choose one of a plurality of data memory locations for entering and storing a user fingerprint or thumbprint, as discussed below. If desired, a raised ridge (524) corresponding to the shape of the handgun trigger guard area may be provided to enhance secure fit of the trigger lock body (502) when it is locked to a handgun (504). A movable detent (526) having ratchet teeth (528) protrudes from an opening (530) in the front wall (512), extending beyond and generally perpendicular to, the plane formed by the front wall (512).

Figure 9:
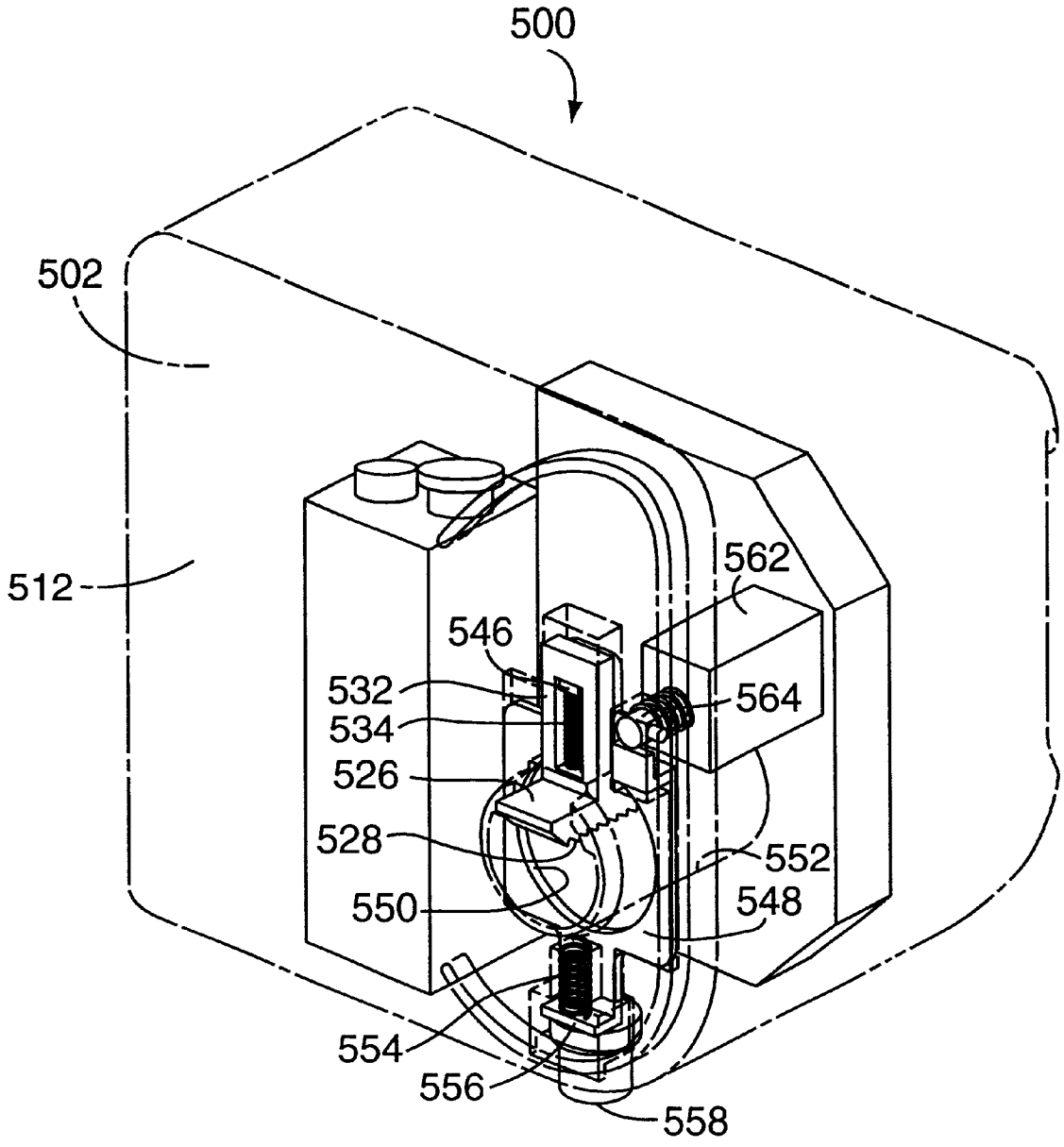
FIG. 9 is a schematic, partial view of the embodiment of FIG. 7.
Figure 10:
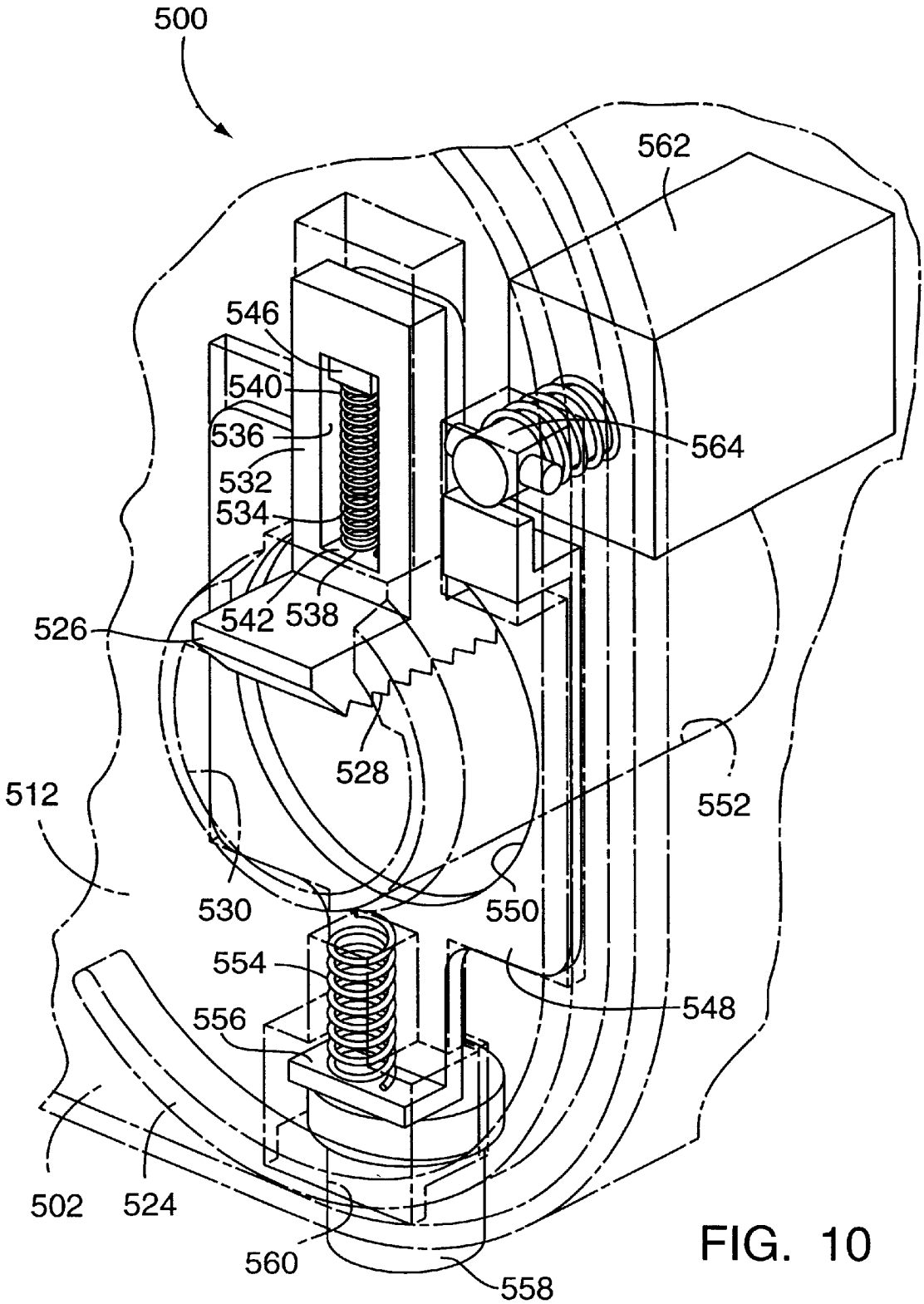
FIG. 10 is a schematic, partial view of the embodiment of FIG. 7.
Figure 11:
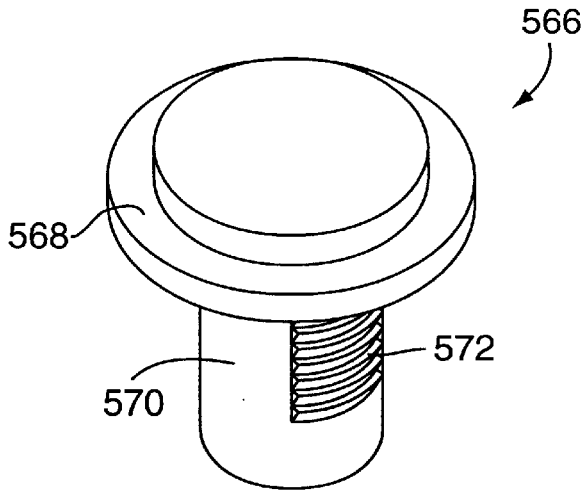
FIG. 11 is a schematic, orthogonal view of a secondary trigger lock piece.

Referring to FIGS. 9–10, which illustrate the internal components of the lock body (502), the detent (526) has a laterally extending section (532), perpendicular to the portion having ratchet teeth (528), that is adapted for sliding, lateral movement along the plane of, and relative to, the front wall (512). The detent (526) abuts a first spring (534) that is contained in a channel (536) in the laterally extending section (532). A first end (538) of the spring (534) contacts the back face (542) of the detent (526). A second end (540) of the spring (534) contacts a tab (546) that is part of a locking member frame (548). The tab (546) is positioned within the channel (536) for relative sliding movement therewith, so that when the frame (548) is held stationary, the detent (526) can move relative thereto along the channel, against biasing force of the spring (534).

The locking member frame (548) is mounted within the lock body (502) generally parallel to the front wall (512) and relatively slideable therewith. The frame (548) has a central opening (550) in which the portion of the detent (526) having ratchet teeth (528) is positioned so that a cooperating locking shaft, as discussed below, engages the ratchet teeth (528) upon insertion into the opening (550). The central opening (550) is aligned with a bore (552) in the body (502) which provides for clearance of the inserted locking shaft. The frame (548) is mounted relative to the body (502) in a sliding, spring-biased manner due to a second spring (554) mounted in contact with and abutting an internal surface of the body (502) at one end, and in contact with and abutting a tab (556) formed on the frame (548) at the other end. A button (558) extending through an opening (560) in the body (502) contacts that opposite side of the tab (556) so that a user can push against the second spring (544) to cause movement of the frame (548) for releasing the locking shaft, as discussed below.

A solenoid (562) is housed in the body (502) and has a movable bar (564) that is aligned for movement generally perpendicular to the movement of the frame (548). The solenoid (562) is positioned so that the bar (564), when extended, impedes movement of the frame (548) in order to maintain a locked position in which a locking shaft interlocked with the ratchet teeth (528) of the detent (526) cannot be released, as discussed below. When the bar (564) is retracted, the frame (548) can move freely to the unlock position.

Referring to FIG. 10, a secondary locking piece (566) adapted to cooperate with the lock body (502) comprises a top portion (568) shaped to engage the front wall (512) and ridge (524) in a complementary manner to securely block access to a trigger of a handgun when the secondary locking piece (566) and the lock body (502) are engaged around a trigger, in a manner similar to conventional trigger locks. The secondary locking piece (566) includes a locking shaft (570) having ratchet teeth (572) for engaging the ratchet teeth (528) of the detent (526). Unlike conventional trigger lock devices, it is not required that the shaft (570) be rotatable with respect to the body of the secondary piece (566), nor is it required that the secondary piece (566) contain any internal locking mechanisms. Optionally, however, a mechanical lock override system may be provided in the trigger lock system (500) for manually unlocking in the event of power failure or malfunction.

In operation, the trigger lock system (500) is manually positioned adjacent to a handgun trigger area. Starting from a locked position, with the solenoid bar (564) extended to block movement of the frame (548), the user inserts the shaft (570) through the trigger guard of the handgun, through the central opening (550) of the frame (548) and into the bore (552). The position of the detent (526) is such that the ratchet teeth (528) of the detent engage the ratchet teeth (572) of the shaft (570) as it passes by. Because the detent (526) is spring biased with adequate clearance between it and the inner edge of the central opening (550), the detent (526) is biased out of the way of passing ratchet teeth (572) until the shaft (570) comes to rest. At that point, the ratchet teeth (572) of the shaft (570) are in locked engagement with the ratchet teeth (528) of the detent (526).

To remove the trigger lock system (500) from a handgun, an authorized user swipes his finger across the scanner (506) on the lock body (502). When an authorized signal is generated, in accordance with the preceding description, the solenoid (562) is actuated so that the bar (564) is retracted, thereby enabling movement of the frame (548). The user pushes the button (558) so that the frame (548) moves into the lock body (502) against the spring force of the second spring (544). The central opening (550) of the frame (502) has a larger diameter than the bore (552) in the lock body (502) so that the central opening (550) can move from an eccentric or offset position to a generally concentric position with respect to the bore (552), while maintaining clearance for the shaft (570) at all times. When the frame (548) is moved, the detent (526), which is biased relative to the frame (548), moves with it in a direction away from the center of the central opening (550). This movement causes the ratchet teeth (572) of the shaft (570) to disengage from the ratchet teeth (528) of the detent (526), thereby enabling the user to withdraw the shaft (570) from the bore (552) and remove the locking assembly (500) from the handgun.

As discussed above, the electronic controls of the system according to the present invention can be configured to perform one or both functions of: enabling unlocking of a locking device or storage box; and enabling operation of a firearm having electronic controls. With respect to the latter, the trigger lock assembly (500) described herein may be configured to activate the electronic firing controls that are located on-board the firearm. The action of entering a fingerprint into the scanner located on the trigger lock body and generating an unlock signal may also generate an operational signal (36) for the firearm or handgun.

Figure 12:
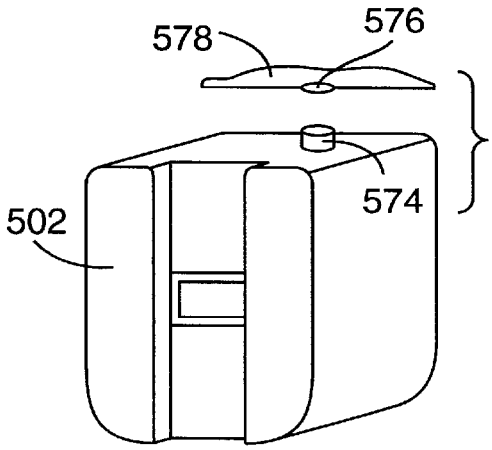
FIG. 12 is a schematic, orthogonal view of a sixth embodiment of the present invention, directed to a trigger lock system.
Figure 13:
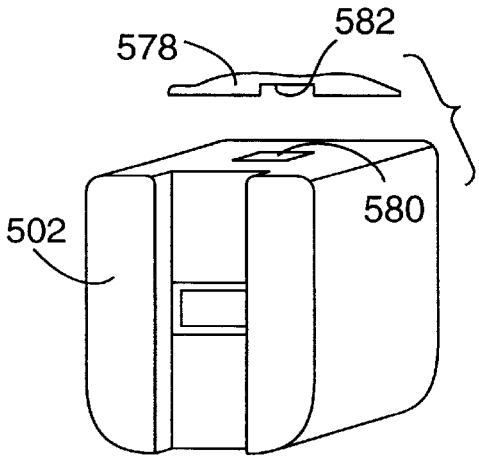
FIG. 13 is a schematic, orthogonal view of a seventh embodiment of the present invention, directed to a trigger lock system.

As shown in FIG. 12, the lock body (502) may be provided with en electrical connection to a handgun through a plug (574) that is adapted to mate with a jack (576) on a handgun or firearm body (578). The plug (574) and jack (576) may be positioned on any one of several mating surfaces or, alternatively, may be replaced by IR or RF connections for transmitting signals between the trigger lock system (500) and the handgun. For example, referring to FIG. 13, an IR or RF transmitter/receiver element (580) may be provided on the lock body (502) and an IR or RF transmitter/receiver element (582) may be provided on a handgun or firearm body (578).

It is understood and acknowledged that the present invention is not limited to fingerprint scanning and firearms, but that the same system may be employed to other types of devices and may implement other biometric data features including, but not limited to, voice recognition, retina scanning and the like.

While the preferred embodiments of the invention have been described herein, it is acknowledged that variation or modification may be made without departing from the scope of the presently claimed invention.

What is claimed is:

1. A locking system for securing a firearm, said system comprising a first body portion adapted to receive said firearm therein;

a second body portion adapted to mate with said first body portion in order to enclose said firearm therein when said second body portion is in a closed position;

locking means for selectively locking said second body in said closed position, said locking means being selectively actuated between a locked position and an unlocked position in response to a locking signal;

data input means for receiving user-input data;

a first control means for generating said signal in response to said user-input data;

a second control means associated with said firearm for activating and deactivating an operating mode of said firearm; and communication means for transmitting an operating signal from said first control means to said second control means, whereby said operating signal activates operation of said firearm.

2. A system according to claim 1, wherein said user-input data comprises biometric data.

3. A system according to claim 1, wherein said user-input data comprises fingerprint data.

4. A system according to claim 1, wherein said locking means comprise a lock mechanism; and a solenoid having a bar movably responsive to an unlocking signal generated by said first control means in order to fix said lock mechanism in a locked position.

5. A system according to claim 1, further comprising second control means, said second control means being associated with said firearm for activating and de-activating an operating mode of said firearm; and communication means for transmitting an operating signal from said first control means to said second control means, whereby said operating signal activates operation of said firearm.

6. A system according to claim 5, wherein said communication means comprise a plug-type electrical connection between said first control means and said second control means.

7. A system according to claim 5, wherein said communication means comprise an infra red connection between said first control means and said second control means.

8. A system according to claim 5, wherein said communication means comprise a radio frequency connection between said first control means and said second control means.

9. A system according to claim 1, wherein said data input means comprise a fingerprint sensor.

10. A system according to claim 9, wherein said fingerprint sensor has a screen located on said first body portion.

11. A system according to claim 5, wherein said second control means are located on said firearm.

12. A system according to claim 11, wherein said first control means are located on said first body portion.

13. A locking system for securing a firearm as in claim 1 further comprising a first body portion is adapted to receive said firearm entirely therein.

14. A method of releasing and enabling a secured, disabled firearm in a system having electronic controls, said method comprising the steps of entering data signals indicative of a user into a controller associated with said system;

comparing said user data to pre-stored data indicative of authorized users;

generating a first signal in response to a match between said user data and said pre-stored data;

activating lock release means in a locking structure in response to said first signal to enable releasing of the firearm; and generating an enablement signal in response to said first signal, for presentation to a security apparatus affixed to said firearm to enable operation of said firearm.

15. A method according to claim 14, wherein said biometric data comprises fingerprint data.

16. A method according to claim 14, wherein said lock release means are activated for only a predetermined time period.

17. A method according to claim 14, wherein said lock release means comprise a solenoid having a movable member for selectively securing and releasing a locking component that secures said firearm.

18. A method according to claim 14, further comprising generating an enablement signal in response to said first signal, whereby said enablement signal enables operation of said firearm.

19. A method according to claim 14, further comprising selectively enrolling one or more sets of said pre-stored data in one or more data storage locations in said system.

20. A method according to claim 18, wherein said enablement signal is received and processed by a firearm controller located on said firearm, where said firearm controller enables operation of said firearm.

21. A method according to claim 14, wherein said locking structure comprises a box having a lid and being adapted to securely enclose said firearm within.

22. A method according to claim 14, wherein said locking structure comprises a trigger lock assembly adapted to engage said firearm around a trigger area to disable operation of a trigger mechanism associated with said firearm.

23. A method of releasing and enabling a secured, disabled firearm as in claim 14, said method further comprising the steps of maintaining said system in SLEEP mode when no input signal is present, thereby conserving power.

24. A locking system for securing a firearm, said system comprising a first body portion adapted to receive said firearm therein;

a second body portion adapted to mate with said first body portion in order to enclose said firearm therein when said second body portion is in a closed position;

locking means for selectively locking said second body in said closed position, said locking means being selectively actuated between a locked position and an unlocked position in response to a locking signal;

input means for receiving signals corresponding to user-input data;

a controller for generating said locking signal in response to said user-input data signals, said control means further including a means for intializing operation of said controller to enable the generation of said locking signal only in response to signals corresponding to defined parameter values;

a means for establishing a controller SLEEP mode in which said controller operation is ceased to minimize power consumption without requiring reinitialization of said controller;

a means for re-establishing operation of said controller in response to a wake-up signal; and a sensor responsive to physical input for generating said wake-up signal.

25. A locking system according to claim 24 wherein said sensor further comprises a biometric sensor.

26. A locking system according to claim 24 wherein said sensor further comprises a pressure sensor.

27. A locking system according to claim 24 wherein said data input means automatically times out after a predetermined time causing said controller to revert to said SLEEP mode.

28. A locking system according to claim 24 wherein said controller automatically times out after a predetermined time, thereby causing said controller to revert to said SLEEP mode.

29. The method of claim 28 further comprising the steps of providing biometric data signals indicative of an authorized user as said input data signals.

30. A method of releasing and enabling a secured firearm in an electronic locking system, said method comprising the steps of initializing operation of a controller to enable the generation of a locking signal only in response to signals corresponding to defined user parameter values;

entering user input data signals into said controller;

comparing said entered data signals to pre-stored user authorized data signals;

generating a match signal in response to a match between said entered data and said pre-stored data signals; and generating said locking signal activating a lock release in response to said match signal to enable release of the firearm;

establishing a SLEEP mode in which said controller operation is ceased to minimize power consumption without requiring reinitialization of said controller;

generating a wake-up signal in response to a sensed physical input to the electronic locking system; and re-establishing operation of said controller in response to a wake-up signal.

* * * * *